US006276543B1

(12) United States Patent
German et al.

(10) Patent No.: US 6,276,543 B1
(45) Date of Patent: Aug. 21, 2001

(54) VENTED COMPOSITE CLOSURE

(75) Inventors: Galen German, Lancaster; Tom Vandewalle, West Worthington, both of OH (US); Min Miles Wan, Plainfield, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/314,507

(22) Filed: May 19, 1999

(51) Int. Cl.[7] ..... B65D 39/00
(52) U.S. Cl. ..... 215/252; 215/276; 215/350
(58) Field of Search ..... 215/252, 274, 215/276, 329, 350, 351; 220/319

(56) References Cited

U.S. PATENT DOCUMENTS

| | | | | |
|---|---|---|---|---|
| 4,809,858 | * | 3/1989 | Ochs | 215/276 |
| 4,813,561 | | 3/1989 | Ochs | 215/252 |
| 4,880,127 | * | 11/1989 | Doi | 215/252 |
| 4,993,572 | * | 2/1991 | Ochs | 215/260 |
| 5,009,324 | * | 4/1991 | Ochs | 215/276 |
| 5,031,787 | * | 7/1991 | Ochs | 215/276 |
| 5,062,538 | * | 11/1991 | Ochs | 215/260 |
| 5,078,290 | * | 1/1992 | Ochs | 215/276 |
| 5,346,082 | | 9/1994 | Ochs et al. | 215/252 |

FOREIGN PATENT DOCUMENTS

| | | |
|---|---|---|
| WO 91 03404 | 3/1991 | (WO) . |
| WO 92 03370 | 3/1992 | (WO) . |

* cited by examiner

*Primary Examiner*—Stephen K Cronin
(74) *Attorney, Agent, or Firm*—Knoble & Yoshida, LLC

(57) ABSTRACT

A composite closure for a container has an outer band with a partial toroidal hook that overhangs a crown around the periphery of an insert cover disk. As the closure is tightened on the container, the hook bears downwardly on the crown of the disk and urges the disk against the container rim. The hook has several vents formed on its underside to enable air communication. A lower, inner edge of the hook is spaced apart from the disk to provide communication with the vents from the environment. An annular recess is formed on the underside of the hook, and is in communication with the vents and with a gap formed between an outboard wall of the crown and an inboard sidewall of the hook. A retaining bead is formed on a skirt below the hook to retain the disk. The bead is spaced apart from the disk when the closure is assembly to a container to enable communication from the environment through the vents to the threads.

28 Claims, 7 Drawing Sheets

12

VENTED COMPOSITE CLOSURE

FIELD OF THE INVENTION

This invention relates to a closure for sealing a food container, and more particularly, to a closure having vents to provide air communication to an internal portion thereof.

BACKGROUND OF THE INVENTION

Composite closures are widely used to seal food containers, for example wide mouth containers that are "retorted" after sealing. Such closures comprise a sealing disk or cover, usually of metal or alternatively plastic, which is encircled and housed within a separately formed molded plastic band or shell. The disk has a raised peripheral crown that presents a downwardly opening groove that contains a sealant or gasket for forming a seal with a sealing rim around the top or finish of the container. The shell holds the disk down on the container but is rotatable relative to the disk so as not to turn the disk on the container, which would greatly increase the torque required for opening or closing. This type of seal is relatively insensitive to the thermal expansion and contraction that occur during retorting. (In retorting, after the container has been filled it is heated to a temperature above about 220 degrees F. under external pressure to sterilize the food sealed in it.)

U.S. Pat. No. 4,813,561, which is incorporated herein in its entirety, shows a composite retortable closure having a metal disk with a raised peripheral bead. The bead presents a downwardly opening groove that contains a sealant or gasket material for making a seal with the top, outer, and/or inward surface of the rim of the container. The disk is rotatably housed within an encircling molded plastic shell having an inwardly projecting curved lip that extends to and engages the top of the bead of the disk. As the shell is tightened, the undersurface of the lip bears downwardly on the disk bead thereby forcing the sealant material into sealing engagement with the container rim. The '561 patent also describes a tamper indicating band around the lower edge of the shell. The band is connected to the shell by a line of weakness provided by a series of small frangible bridges, and includes an upwardly and inwardly projecting band retainer. Interengaging ratchet teeth are provided on the container and the inwardly facing surface of the retainer. When the closure is first opened, the interengaging ratchet teeth prevent the retainer from turning with the rest of the closure, which in turn causes the tamper evidencing band to break off along the line of weakness. The band then drops downwardly, thereby indicating at least partial opening.

U.S. Pat. No. 5,346,082, which is incorporated herein in its entirety, discloses a composite closure for a container. The closure has an outer shell with a half-toroidal lip that overhangs a bead around the periphery of an insert cover disk. As the closure is tightened on the container, the lip bears downwardly on the crown of the disk and urges the disk against the container rim. Reaction force uncoils the hook like a watch spring, and a visible gap develops between the inner edge of the lip and the disk. This gap provides a visible on-line indicator that the hook is exerting sealing force on the disk. The '082 patent also discloses an improved tamper evident band.

The '082 patent discloses channels for enabling water to drain or dry from the interthread space around the threads of the container and closure. The '082 patent disclosed a closure having a movable gap between the edge of the lip and the disk, and channels to promote draining and drying. The gap unwinds in response to tightening of the closure onto the container. It is a goal of the present invention to provide a composite retortable closure that has improved draining and drying characteristics.

SUMMARY OF THE INVENTION

A retortable closure package is provided that comprises a container and a closure. The container has a securement member formed thereon, which preferably is a single continuous thread. According to the present invention, the closure includes a metal disk and a molded plastic band. The disk has a center portion and an annular raised crown disposed around the center portion. The crown has a groove formed on an underside thereof that contains a gasket engageable with a rim of the container. The band has an inwardly extending semi-toroidal annular hook and a skirt extending downward from the hook. The skirt has a securement member, which preferably is a single continuous thread, which is engageable with the securement member on the container. The hook has a lower edge opposite the skirt that is spaced apart from the disk.

According to an aspect of the present invention, an underside of the hook includes pads, vents, and an annular recess. The plurality of pads urges downward against the crown (preferably at the apex of the crown) exerting downward force on the crown and not exerting radial clamping force across the crown in response to coupling together the closure and the container. An annular recess is formed in the underside of the hook and defines an end of the pads. The plurality of vents is disposed between the pads, and an end of the vents is defined by the annular recess, whereby the vents provide communication between the securement members and the environment to enable evaporation of liquids disposed within the closure.

The closure according to the present invention preferably includes an annular retaining bead inwardly projecting from the skirt. The retaining bead holds the disk while the closure is uncoupled from the container. When the closure is applied, the container urges upward against the disk to provide space between the retaining bead and an edge of the disk, thereby enabling communication between the vents and the securement members.

The hook underside has an outboard portion defined by the annular recess and the retaining bead, and the outboard lower portion is spaced apart from the crown to enable communication between the vents and the securement members. Preferably, the vents are coextensive with the hook from the disk edge to the annular recess and have a substantially uniform thickness. The pads also have substantially uniform thickness. The lower portion of the hook above a retaining bead lacks vents, and is spaced apart from an outside wall of the crown. The package further has a tamper evident band that includes ratchets that restrict opening of said closure.

BRIEF DESCRIPTION OF THE DRAWINGS

The invention can best be further described by reference to the accompanying drawings, in which.

DETAILED DESCRIPTION OF THE PREFERRED EMBODIMENT(S)

Figure 1:
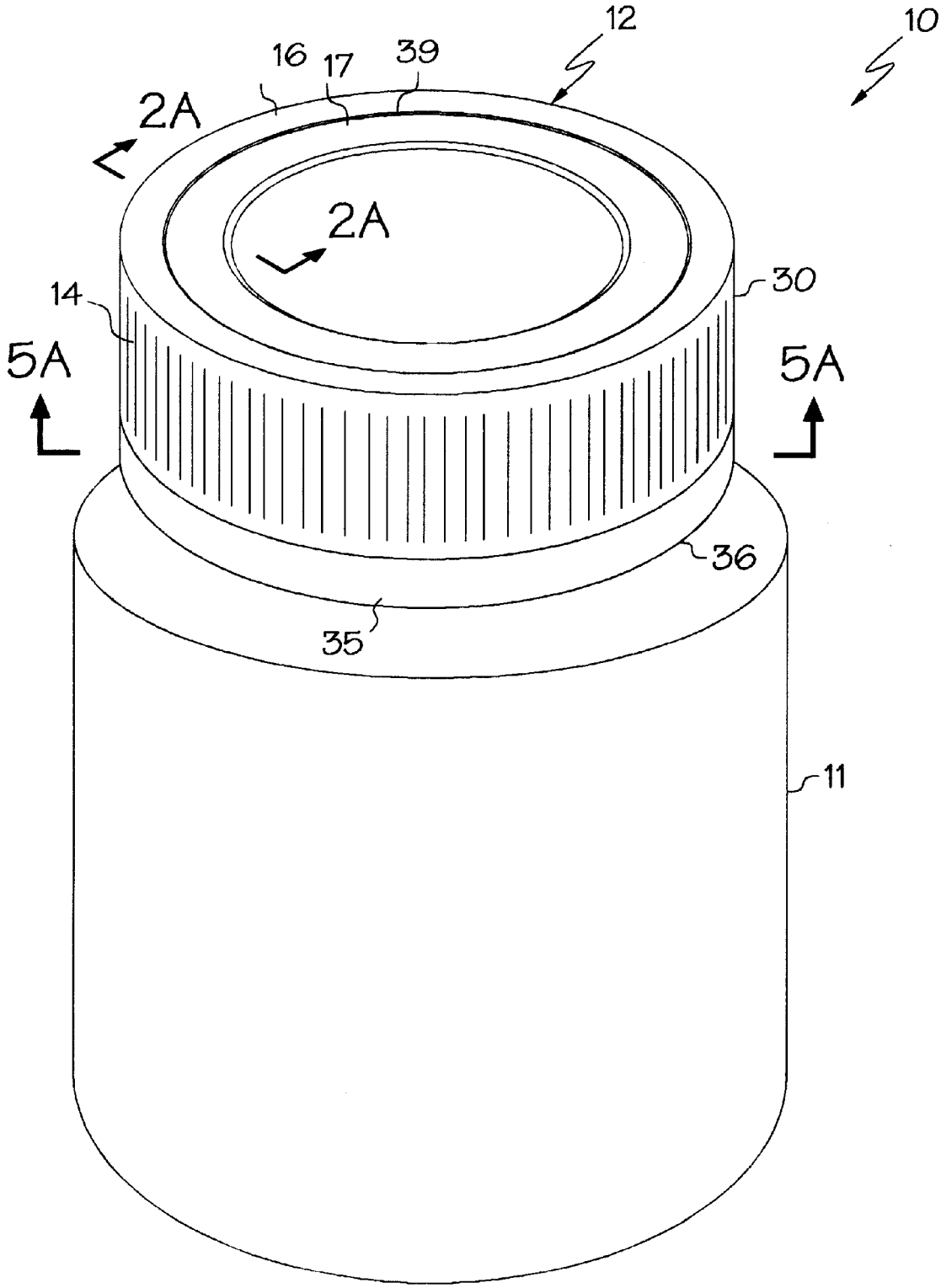
FIG. 1 is a perspective view of a sealed package in accordance with the invention.

FIG. 1 shows a sealed package 10 that comprises a container 11 in the form of a wide mouth jar, and a closure 12. Closure 12 comprises a molded plastic annular band or shell 14 and a cover or insert disk 17 that is received in band 14 below an inwardly projecting lip or hook 16 of the band. Disk 17 is preferably axially movable within band 14, and is retained from below by an inwardly projecting retaining boss or bead 26 (FIGS. 2A, 2B, and 3) on the band.

Figure 2A:
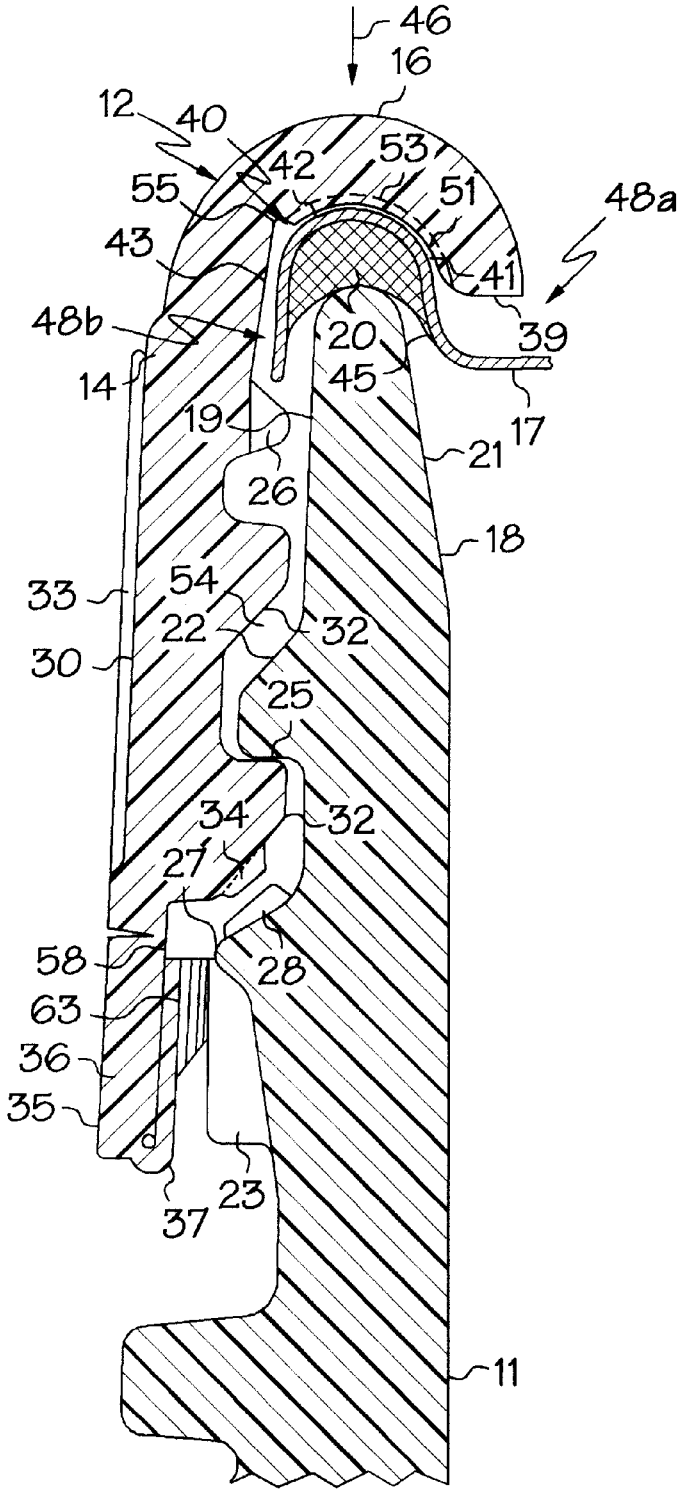
FIG. 2A is an enlarged section taken on line 2A—2A of FIG. 1, but shows the closure as it is being tightened on the container.
Figure 4:
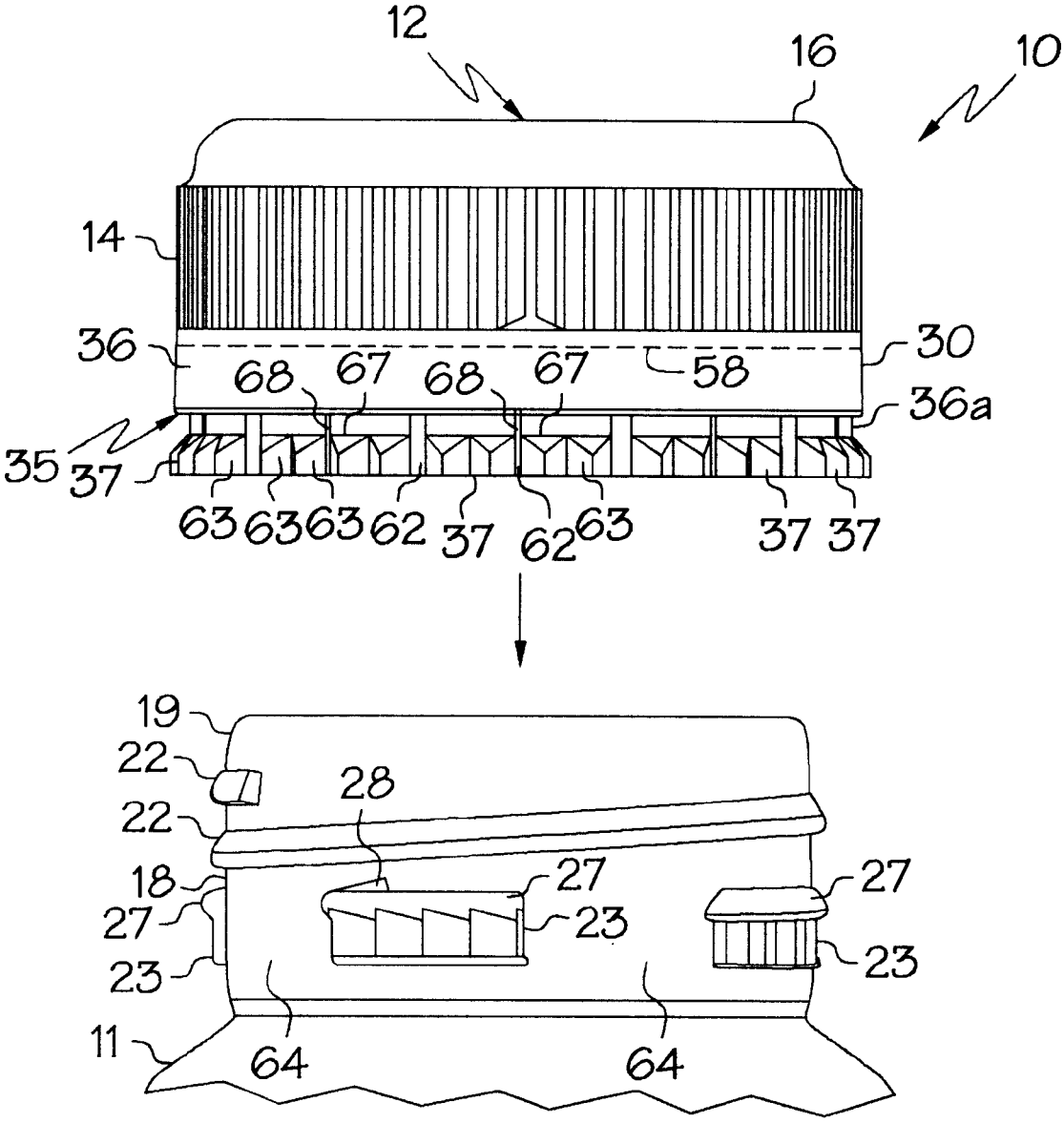
FIG. 4 is a side elevation, partly broken away, of the closure and the top portion of the container.

Referring to FIGS. 2A and 4, container 11 typically is formed of blow molded plastic and is an integral one-piece body. It has a finish 18, a securing member 22 on its outer surface, and several spaced sets of ratchets 23 below the securement member. The container finish 18 is tapered in vertical cross section, having an outer surface 19, a rounded rim 20 and an inner surface 21. In the embodiment shown, the securement member 22 is a single continuous thread, but the invention also contemplates the use of lugs or multiple threads. The thread of securement member 22 preferably has a flat lower surface 25. Below securement member 22 and immediately above each set of ratchets 23 is a segmented ratchet cam 27 (FIG. 4). Cams 27 assist the engagement and seating of the closure ratchet fingers in the container sets of ratchets. Once seated, the fingers need not interengage thereafter with the cams; the function of the cams 27 is not to prevent vertical motion of the retainer during closure removal, but rather to initially seat the ratchets so that they do not thereafter rotate. On its upper surface, one cam 27 presents an upstanding stop or boss 28 that engages a cooperating stop on the closure in order to limit rotation of the closure on the securement member 22, as will be described.

Figure 3:
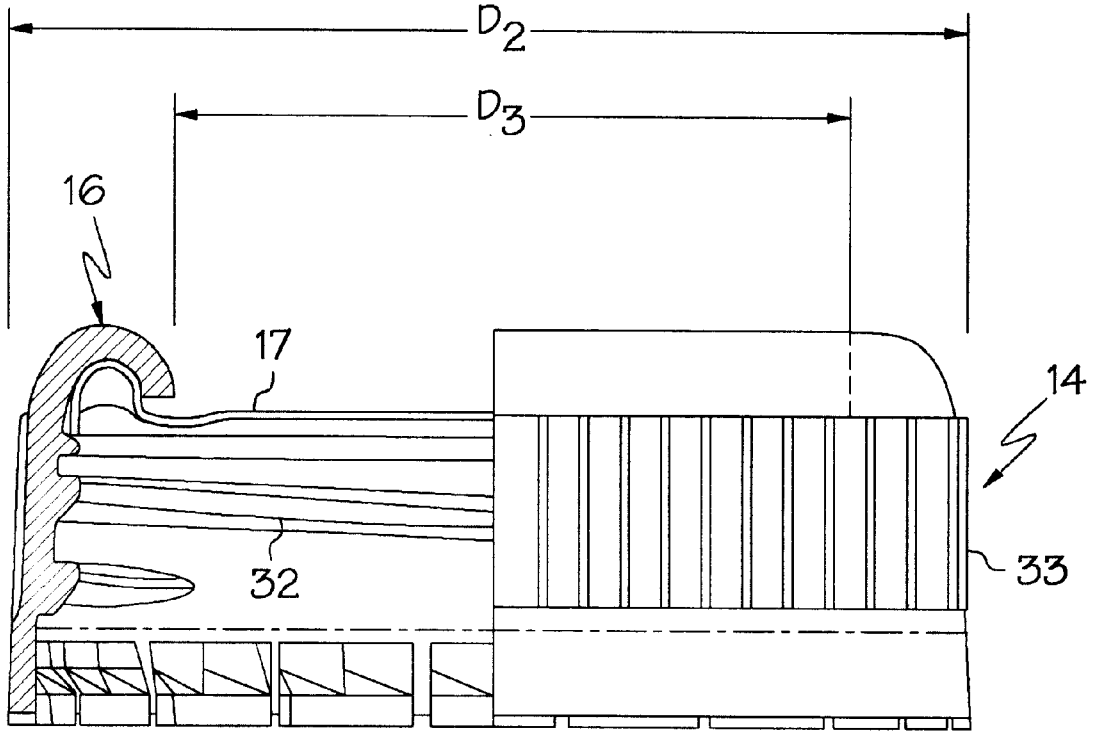
FIG. 3 is a side view of the closure shown in FIG. 1 with a portion cut away to illustrate a section.

Band 14 of closure 12 includes a skirt 30 on the inside surface of which is a securement member 32, which is shaped to coact with the cooperating securement member 22 of the container (see FIG. 3). On its outside surface skirt 30 may have gripping means such as ribs 33 or knurling. Adjacent its lower end, closure thread 32 has a stop 34 which, as the closure is tightened, comes rotationally into abutment with stop 28 on the container to limit further rotation. Optionally but preferably, the closure has a tamper-evidencing system 35, which preferably includes a detachable band 36 and, hinged to the band along its lower edge, a series of upwardly and inwardly projecting ratchet fingers or tabs 37.

Figure 2B:
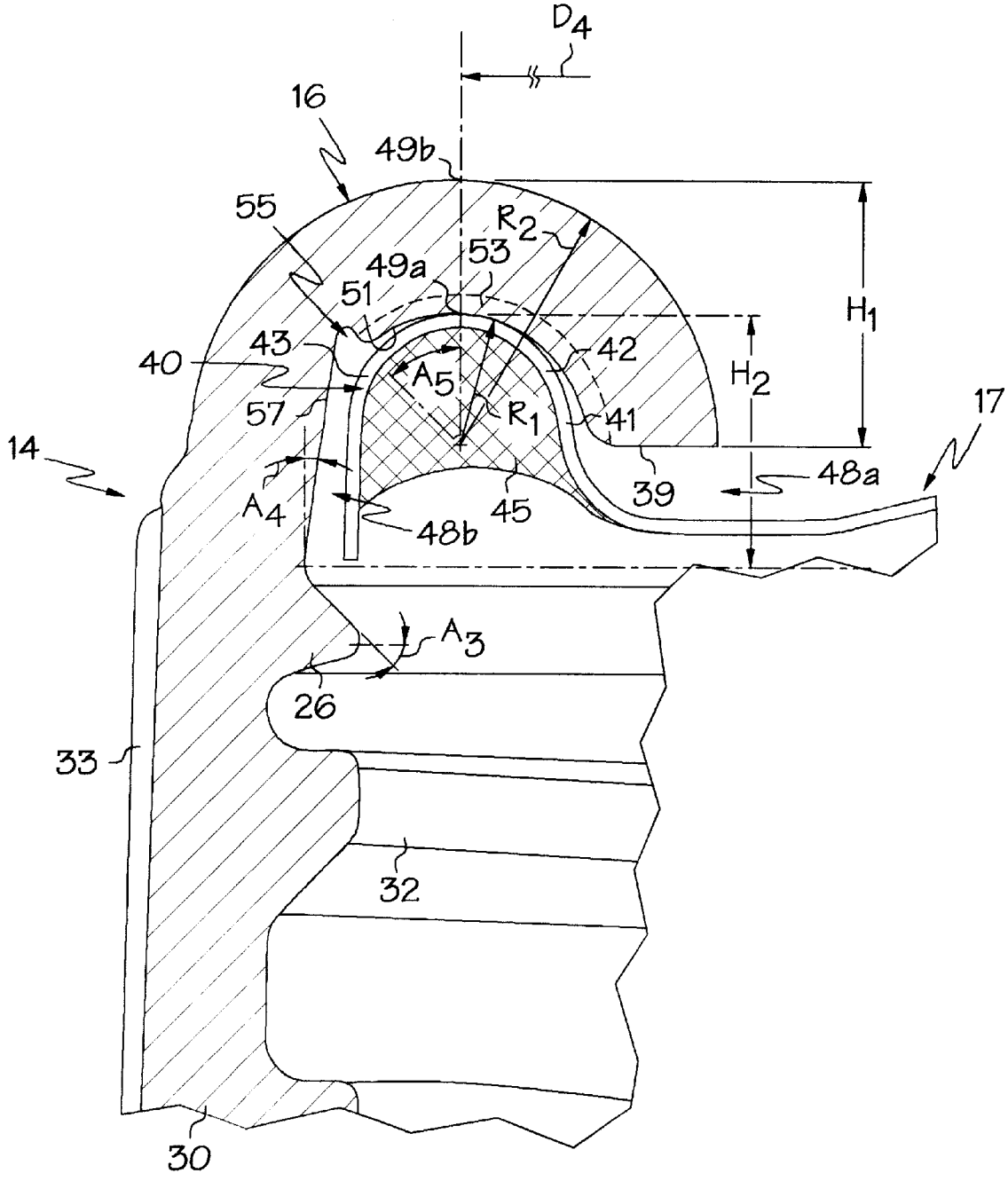
FIG. 2B is an enlarged view of a portion of the closure shown in FIG. 2A with the container removed for clarity.

At the top of band 14, hook 16 curves inwardly, then downwardly, having a C-shaped or approximately semicircular or partial toroidal vertical cross section (see FIGS. 2A and 2B). Hook 16 curves inward to a lower edge 39. When the closure is tightened on the container, hook 16 exerts downward force on a raised peripheral crown 40 on disk 17. The crown 40 has an upstanding inside wall 41, a curved top 42, and a downwardly curving outside wall 43, and thereby presents a downwardly opening channel on an underside of crown 40. A flexible seal or gasket 45, for example a conventional plastisol, is deposited in the crown channel. Either as formed or as used, gasket 45 conforms to the outer sealing surface 19, rim 20, and/or the inner sealing surface 21 of the closure finish for forming a seal therewith.

Disk 17 contacts the underside of hook 16 at an apex 49*b* of crown 40. A first gap 48*a* is formed between disk 17 and a lower edge 39 of hook 16. A second gap 48*b* is formed between disk outside wall 43 and a lower region 57 of hook 16 that transitions into skirt 30, as best shown in FIG. 2B. Lower region 57 is formed by a substantially straight wall that defines an angle A4 of eight degrees with a vertical line. Referring to FIG. 3, closure 12 preferably has an outer diameter D2 of 1.71 inches (4.34 cm), and the inboard-most portion of hook 16 (proximate edge 39) forms an inner diameter D3 of 1.128 inches (2.87 cm). Referring to FIG. 2B, closure 12 preferably has a diameter D4 (which is the diameter formed by an apex 49*b* of hook 16) of 1.398 inches (3.551 cm).

Hook 16 is defined by an inner radius R1 of 0.069 inches (1.75 mm), which is defined by pads 51, and an outer radius R2 of approximately 0.094 inches (2.38 mm). Lower edge 39 protrudes below a top of hook 16 by a distance H1 of 0.132 inches (3.35 mm). A top of retaining bead 26 is disposed below an inner peak of hook 16 (that is, at the highest point defined by pads 51) by a distance H2 of 0.132 inches (3.35 mm). Retaining bead preferably is defined by a top surface that forms an angle A4 of 45 degrees with a horizontal line.

In order to make the seal between the disk gasket and the container, a downward force is applied to the top 42 of crown 40, as indicated by the arrow 46 in FIG. 2A. Engagement of the hook 16 with the crown top 42 applies a downward sealing force as the closure is tightened on the container. Preferably, the sealing force is applied at an apex 49*a* of crown 40. Crown apex 49*a* preferably is directly vertically below hook apex 49*b*. Preferably, disk 17 is formed of metal or other rigid material so that it is sufficiently rigid not to be deformed by the force but will rather compress the gasket 45. Hook 16 clamps crown 40 like a C-clamp. Hook 16 is intended not to deflect during tightening, and therefore does not provide the visual indication of torque as in U.S. Pat. No. 5,346,082. However, the present invention encompasses employing such a visible indication of torque.

According to the present invention, hook 16 has a plurality of pads 51 between a plurality of notches or vents 53 formed on an underside of hook 16, as shown in FIGS. 2A, 2B, 5B, and 6. Preferably, nine pads 51 alternate between nine vents 53, which are uniformly spaced on the underside of hook 16, as best shown in FIG. SB. Pads 51 engage the top 42 to exert the downward pressure on crown 40 to urge crown 40 downward against the container rim 20 and wedge gasket 45 against the outside and/or inside rim surfaces 19, 21, respectively. Crown 40 exerts an equal and opposite upward reaction force on hook 16.

Figure 5A:
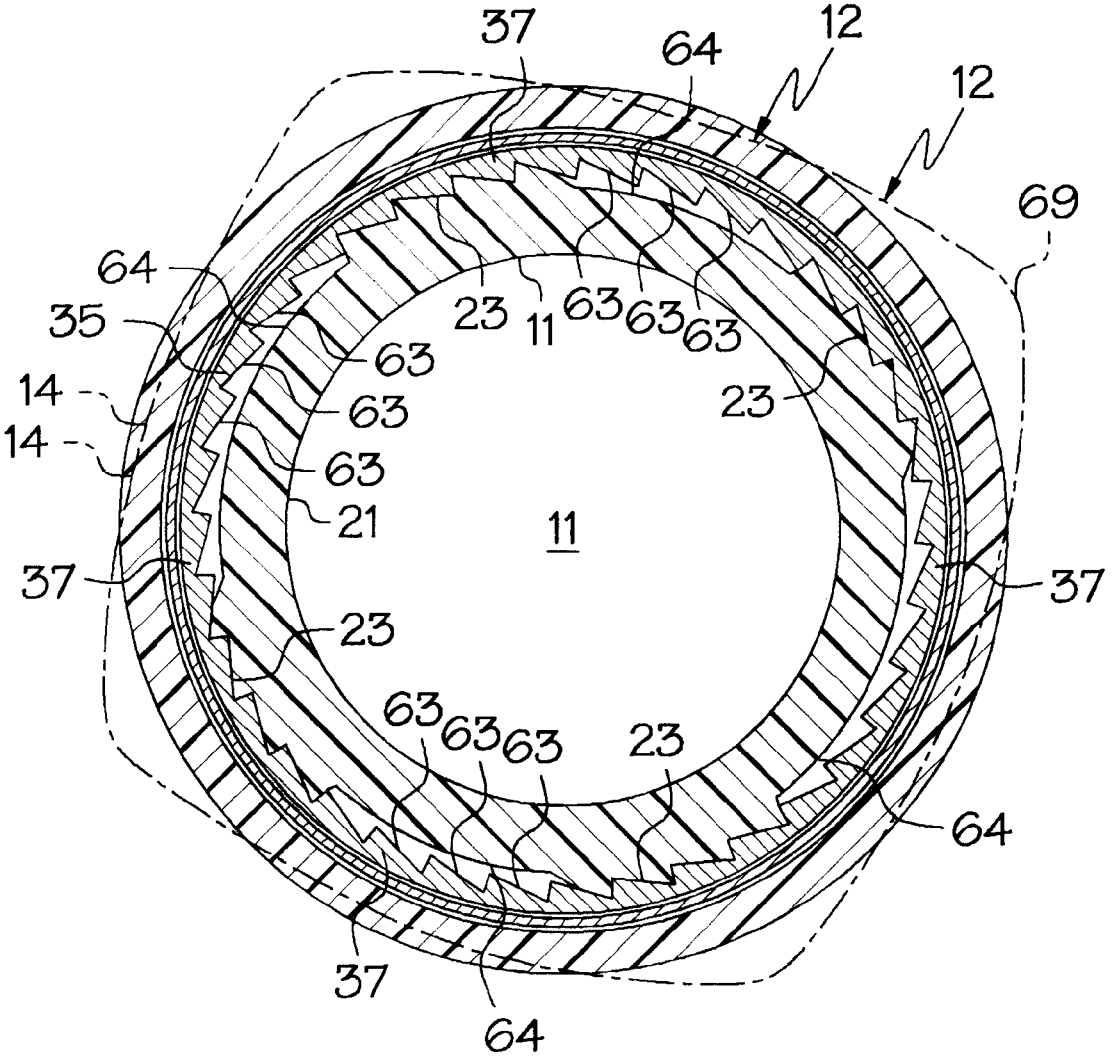
FIG. 5A is an enlarged cross-sectional view of a portion of the sealed package, taken on line 5A—5A of FIG. 1.
Figure 5B:
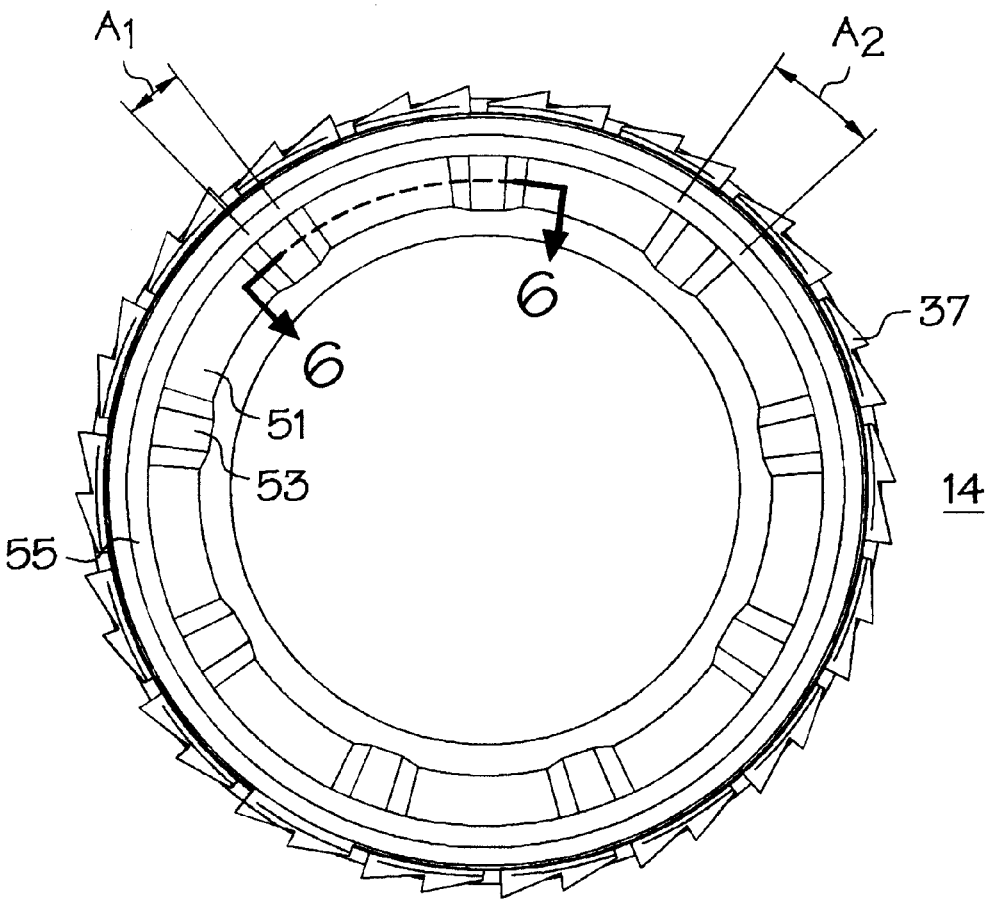
FIG. 5B is an enlarged bottom view of a component of the sealed package.
Figure 6:
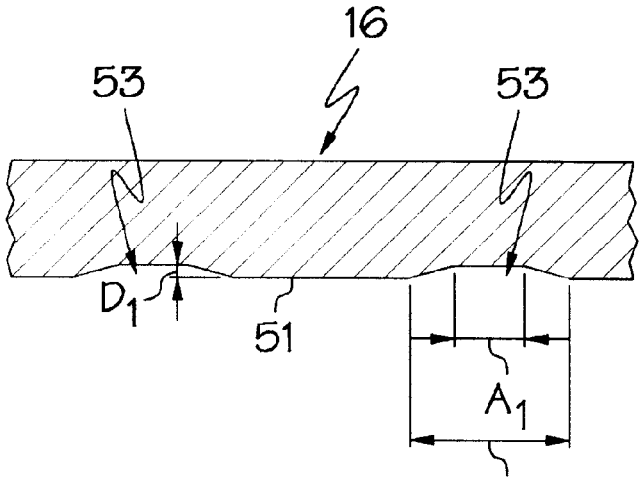
FIG. 6B is an enlarged cross-sectional view of line 6—6 of FIG. 5B, which is taken approximately at an apex of the closure hook.

FIG. 5B shows a bottom view of band 14 with disk 17 and container 11 removed for clarity, and shows detachable band 36 having interconnected tabs 37 (that is, adjacent tabs 37 are connected). Thus, FIG. 5B shows a modified tamper evident band 36 with which the present invention may be employed. Referring to FIGS. 5B and 6, vents 53 preferably are formed by angularly oriented notches, each of which subtends an angle A1, which preferably is approximately seven degrees. Referring particularly to FIG. 6, which shows a sectional view of hook 16 near apex 49*b*, vents 53 have a substantially flat bottom and angled sidewalls that slope outward (angularly) from the bottom. The angle A1 corresponds to the bottom, and an angle A2 defines the outermost portion of the sidewalls, which yield to pads 51. Preferably, angle A2 is approximately 14 degrees. Because nine vents 53 are substantially equally spaced apart, the vents are mutually spaced apart 40 degrees (center-to-center). Pads 51, therefore, subtend and angle of approximately 33 degrees. Each vent 53 preferably has a depth D1 of approximately 0.015 inches (0.038 mm).

An annular recess 55 is formed on the underside of hook 16 at an outboard side thereof and is in communication with the vents 53 and with a gap 48*b* formed between an outboard wall of the crown and an inboard sidewall of the hook 16. Recess 55 defines an end of each of the pads 51, and preferably has a depth that is substantially the same as depth D1 of vents 53. Recess 55 is disposed at an angle A5 of 40 degrees from a vertical reference line. In an assembled configuration, wherein pads 51 contact crown 40, vents 53 form the only communication passage from an inboard side of the underside of hook 16 to an outboard side thereof. Specifically, in this assembled configuration container the gap 48*a* between hook edge 39 and disk 17 is continuously open regardless of how tight the closure is secured so as to stay in direct communication with the environment (that is, the ambient area on and above the outer surface of closure 12) and the outer end of vents 53. Vents 53 continuous on the underside of hook 16, and communicate with annular recess 55.

According to an aspect of the present invention, annular recess 55 enhances or enlarges the upper portion of gap 48*b*. Thus, recess 55 enables a passage (which includes vents 53) that has a substantially even depth (that is, that minimizes constriction points). Recess 55 is in communication with gap 48*b*, which is formed between hook 16 and crown 40 from recess 55 to retaining bead 26. Because disk 17 is urged upward by container 11 upon assembly, disk 17 is in the position substantially as shown in FIG. 2B, such that a lower edge of the crown outside wall 43 is spaced apart from retaining bead 26 to provide communication between gap 48*b* and securement members 22 and 32. The dimension of gap 48*a* may vary according to the particular embodiment and disk employed, although gap 48*a* is intended to be at least as large (preferably much larger) as the depth D1 of vents 53. Gap 48*b* will vary according to the particular embodiment and disk employed, and will vary along the length of hook portion 57, although gap 48*b* is intended to be at least as large (preferably much larger) as the depth D1 of vents 53.

The continuous communication of threads 22 and 32 through closure 12 (that is, between hook 16 and disk 17) provides for the flow of wash water or drying air under hook 16, over crown 40, downwardly past crown outer wall 43, and into the interthread space 54 around the securement members 22 and 32. Closure 12 thereby enables package 10 to be immersed in liquid during the retorting operation, and air dry such that liquid entrained in the interthread space will evaporate in a timely manner to promote cleanliness. Also, compressed air may be employed to urge entrained liquid from interthreaded space 54. The flow can exit from the lower end of the interthread space between tamper evidencing means 35 and the container finish. Thus, the closure of the present invention provides air communication between the environment and the area of the package containing threads 22 and 32. Such air communication is important to promote cleanliness, which may occur in an improperly or insufficiently ventilated thread area.

It is desirable to limit rotation of the closure to a predetermined position which is determined by the point at which the stops 28, 34 abut. This limits the maximum torque applied. Together with the semi-toroidal hook, this provides a positive and known pressure on the seal which is largely independent of application torque, temperate, expansion, lubricity, and so on, and at the same time it provides a known or constant removal torque after the assembled container and closure have aged for a few days and the normal plastic creep or relaxation have occurred.

Insert disk 17 snaps into the band and is retained by a disk-retaining snap bead 26. Disk 17 is preferably axially movable between snap bead 26 and hook 40. Because disk 17 is rotatable in band 14, when the closure 12 is unscrewed the closure can turn on the container while disk 17 is held stationary by frictional engagement with the rim 20. The closure band 14 can move upwardly relatively to disk 17 until the disk retaining bead 26 abuts the lower edge of disk wall 43; thereafter it lifts the disk, breaks the seal, and permits air to enter the container.

Turning next to the ratchet means, as indicated above it is preferred to provide a tamper-indicating band 36 that separates upon initial opening of the closure, to provide visual indication that the closure has been at least partially opened. In order to assure that the tamper-indicating band 36 is ruptured promptly, after just a small degree of rotation, it is further desirable to provide the ratchet interlock between the tamper-indicating band and the container 11, so that the tamper-indicating band is essentially prevented from following any rotation of the closure.

The tamper-indicating band 36 is formed as a downward extension of closure skirt 30, but is detachable or frangible attached to it by a line of weakness, formed for example by a series of cuts separated by interim bridges 58, as is known in the art. (The bridges can for example be 0.005" to 0.030" wide ×0.040" thick.) Along its lower edge band 36 has a band retainer 36*a* that comprises a plurality of hinged angularly spaced tabs or spring fingers, designated individually by 37 (see FIGS. 2A and 4). Each finger 37 is hinged to the band and presents one or more ratchets 63 (in the embodiment shown each finger has two ratchets 63). Alternate adjacent fingers are separated from one another by slots or gaps 62 that extend to the lower edge of band 36 (see FIG. 4). The fingers 37 are individually so stiff that if they were not separated by the gaps 62, they could not as a practical matter be inverted from the down "as molded" position (FIG. 4) to the inverted up "use" position in which they are folded upwardly from the band (FIG. 2A). In the embodiment shown, a gap 62 is provided between pairs of fingers 37, that is, two fingers-gap-two fingers-gap, and so on. A web 67 at the outer ends of the fingers connects alternate pairs of fingers. (The webs may for example be about 0.014" thick ×0.075" high.) An opening 68 is formed between each web 67 and the lower edge of band 36.

When the closure 12 is being secured, the hinged connection of the ratchet fingers 37 to the band 36 provides a spring bias on the fingers, urging them inwardly toward the container. The fingers yield outwardly to pass over the respective cam 27 (FIG. 2A), which guides them to seat with the ratchet sets 23.

As shown in FIGS. 4 and 5A, ratchets 63 on the closure are spaced substantially uniformly around the closure, whereas the ratchets 23 on the container are arranged in preferably four equally spaced groups, centered about 90 degrees apart, with spaces 64 between them. The angular width of each space 64 is preferably at least 35 degrees, and the spaces are preferably unequal in width (see FIG. 5A). The angular width of each space is preferably no less than that of a group of ratchets. Because of these spaces only some of the closure ratchets 63 will be engaged with container ratchets 23; in the areas opposite the spaces 64 the closure ratchets are not engaged.

In the past, substantially all of the closure ratchets 63 were engaged with ratchets 23 on the container, and the bridges 58 all broke essentially simultaneously. Because they all broke at once, the total torque required to break them was the sum of their individual breaking torques. In order to keep the total torque required for bridge breaking sufficiently low for a user who might be an older person or arthritic and unable to exert a strong twist), the individual bridges had to be made relatively weak. Such engineered weakness of the bridges in turn sometimes caused inadvertent breakage during closure application. If, for example, a closure was applied slightly cocked or askew, or did not engage properly, some bridges might break prematurely, resulting in a reject.

The spaces 64 cause the bridges to break sequentially rather than simultaneously. Less force acts on the later breaking bridges, and they do not break at the same time as the first bridges to break. It is believed that this time delay occurs because the spaces 64 permit the band 36 and the attached retainer 36*a* to distort as they are torqued from their normal generally circular configuration to a more polygonal configuration, which in turn applies the shear stress unequally and causes some bridges to break sooner than others. More specifically, the closure ratchets 63 which are engaged with container ratchets 23 are held against rotation, but those which overlie the ratchet group spaces 64 are not gripped; and the tension tends slightly to distort the tamper evidencing band 36 across the gaps 50 by flattening its normal circular shape. This distortion is shown in FIG. 5A by the dotted line 69, in highly exaggerated form. The distortion, though actually slight, forms corners or relatively sharper bends in the band 36 adjacent the ends of the groups of container ratchets 23. The shearing stress on the bridges 58 is unequal around the circumference of the distorted band, and the bridges closest to the spaces break first. Bridge breaking then progresses sequentially to other bridges 58, including those that are closer to the spaces 64. It is the rotation which shears the bridges, not any axial hold down force on the fingers.

It should be noted that the angular positions of the bridges with respect to the ratchets on the container is not generally predeterminable, as a practical matter. The bridges 58 are typically formed with a slitting wheel which cuts a slit through the band, then skips over an area which remain as a bridge, then slices through again. The positions of the bridges are thus not correlated to the ratchets or threads on the closure, nor to the container ratchets.

Because the bridges break sequentially, the total breaking force required at any given moment is not the sum of the forces required to break a few bridges, but rather only that required to break a few bridges. Since that force is distributed among fewer bridges, all the bridges can be made relatively stronger while required force still remains desirably low. This reduces the incidence of premature bridge breaking. After the bridges break, the band 36 drops from the upper part of the band. The band preferably remains on the bottle finish, below the thread. As the band is turned it moves farther upwardly on the container and rib 26 lifts the disk and breaks the seal.

It can be seen in FIG. 5A that because the ratchets 23 and 63 on both the closure and the container are typically formed in split molds (which split on a centerline to open), the ratchets do not all have the same cross sectional shape. In order to make allowance for withdrawal of split mold sections from the ratchets, some ratchets cannot have an undercut face, only a slanting face. All the ratchets thus do not necessarily grip effectively, and as a result there is a tendency for ratchet fingers that are most strongly engaged to tip sideways and slip. Such slippage allows the closure ratchets to slide over the container ratchets without rupturing the bridges. However, it has been found that by providing the connecting webs 67 between the outer portions of several fingers, the fingers are made sufficiently stiff that they do not twist or cock circumferentially, and this problem is overcome. The gaps 62, 68 between the fingers provide exit slots for drying air blown through the interthread space.

It should be noted that while the sealing force indicating feature and the ratchet feature are preferably used together, they can be used separately. Where only the ratchet feature is to be used, the hook need not be configured to unwind significantly and the insert disk can be plastic or composite insert disk, as well as metal.

Having described the invention, those skilled in the art will understand from the foregoing description that the invention can be used in other embodiments within the scope of the following claims.

We claim:

1. A retortable closure package comprising:

a container having a securement member formed thereon; and a closure including a metal disk and a molded plastic band; the disk having a center portion and an annular raised crown disposed around said center portion, the crown having a groove on an underside thereof that contains a gasket engageable with a rim of the container; the band having an inwardly extending semi-toroidal annular hook and a skirt extending downward from the hook, the skirt having a securement member engageable with the securement member on the container, the hook having a lower edge opposite the skirt that is spaced apart from the disk when said closure is secured to said container so as to define a gap between said disk and said lower edge, an underside of the hook including:

a plurality of pads urging downward against the crown exerting downward force on the crown and not exerting radial clamping force across the crown in response to coupling together the closure and the container;

an annular recess formed in the underside of the hook and defining an end of the pads; and a plurality of vents disposed between the pads, one end of the vents being in communication with the annular recess and another end of the vents being in communication with said gap, whereby the vents provide communication between the securement members and the environment to enable evaporation of liquids disposed within the closure.

2. The package of claim 1 wherein the pads contact an apex of the crown when the closure and the container are coupled together.

3. The package of claim 2 further comprising an annular retaining bead inwardly projecting from the skirt, the retaining bead holding the disk while the closure is uncoupled from the container, the container urging upward against the disk in response to coupling the container with the closure to provide space between the retaining bead and the lower edge of the disk, thereby enabling communication between the vents and the securement members.

4. The package of claim 2 wherein the vents are coextensive with the hook from the disk edge to the annular recess.

5. The package of claim 4 wherein the hook underside has an outboard lower portion defined by the annular recess and the retaining bead, the outboard lower portion is spaced apart from the crown to enable communication between the vents and the securement members.

6. The package of claim 5 wherein the underside outboard portion lacks vents and lacks pads.

7. The package of claim 4 wherein an inboard portion of the hook underside has a substantially uniform thickness.

8. The package of claim 7 wherein the vents have a substantially uniform thickness and the pads have substantially uniform thickness.

9. The package of claim 4 wherein the plurality of vents comprises nine vents substantially equally radially spaced apart, and the plurality of pads comprises nine pads substantially equally radially spaced apart.

10. The package of claim 4 wherein each one of the plurality of vents subtends an angle of approximately seven degrees.

11. The package of claim 1 wherein the container securement member comprises a container thread and the closure securement member comprises a closure thread, the container thread and the closure thread engageable to couple together the closure and the container.

12. The package of claim 1 further including a tamper evident band.

13. The package of claim 12 wherein said tamper evident band includes ratchets that restrict opening of said closure.

14. The package of claim 13 wherein said hook has a substantially uniform thickness between the hook lower edge and the annular recess.

15. A retortable closure for use with a container that includes a sidewall, a rim formed on the sidewall, and a thread formed on the sidewall, the closure comprising:

a metal disk including a center portion and an annular raised crown disposed around said center portion, the crown having a groove on an underside thereof that contains a gasket engageable with the container rim; and a molded plastic band including an inwardly extending semi-toroidal annular hook and a skirt extending downward from the hook, the skirt having a thread engageable with the container, the hook having a lower edge opposite the skirt that is spaced apart from the disk when said closure is secured to said container so as to define a gap between said disk and said lower edge, an underside of the hook including:

a plurality of pads urging downward against the crown exerting downward force on the crown and not exerting radial clamping force across the crown in response to coupling together the closure and the container;

an annular recess formed in the underside of the hook and defining an end of the pads; and a plurality of vents disposed between the pads, said vents being in communication with both said annular recess and said gap, whereby the vents provide communication between the skirt thread and the environment to enable evaporation of liquids disposed within the closure.

16. The closure of claim 15 wherein the pads contact an apex of the crown when the closure and the container are coupled together.

17. The closure of claim 16 further comprising an annular retaining bead inwardly projecting from the skirt, the retaining bead holding the disk while the closure is uncoupled from the container, the container urging upward against the disk in response to coupling the container with the closure to provide space between the retaining and the lower edge of the disk, thereby enabling communication between the vents and the skirt thread and the container thread.

18. The closure of claim 16 wherein the vents are coextensive with the hook from the disk edge to the annular recess.

19. The closure of claim 18 wherein the hook underside has an outboard lower portion defined by the annular recess and the retaining bead, the outboard lower portion is spaced apart from the crown to enable communication between the vents and the skirt thread.

20. The closure of claim 19 wherein the underside outboard portion lacks vents and lacks pads.

21. The closure of claim 18 wherein an inboard portion of the hook underside has a substantially uniform thickness.

22. The closure of claim 21 wherein the vents have a substantially uniform thickness and the pads have substantially uniform thickness.

23. The closure of claim 18 wherein the plurality of vents comprises nine vents substantially equally radially spaced apart, and the plurality of pads comprises nine pads substantially equally radially spaced apart.

24. The closure of claim 18 wherein each one of the plurality of vents subtends an angle of approximately seven degrees.

25. The closure of claim 15 wherein the container thread and the skirt thread are engageable to couple together the closure and the container.

26. The closure of claim 15 further including a tamper evident band.

27. The closure of claim 26 wherein said tamper evident band includes ratchets that restrict opening of said closure.

28. The closure of claim 27 wherein said hook has a substantially uniform thickness between the hook lower edge and the annular recess.

* * * * *